US008935020B2

(12) United States Patent
Wiemeyer et al.

(10) Patent No.: US 8,935,020 B2
(45) Date of Patent: Jan. 13, 2015

(54) BACK-UP AND REDUNDANCY OF MODULES IN LOCOMOTIVE DISTRIBUTED CONTROL SYSTEMS

(71) Applicant: Electro-Motive Diesel, Inc., LaGrange, IL (US)

(72) Inventors: James Fredrick Wiemeyer, Homer Glen, IL (US); Michael Patrick Deitz, Naperville, IL (US); Dale Alexander Brown, LaGrange, IL (US); Lawrence Stanley Przybylski, Lemont, IL (US); Wayne Allen Rudolph, Lemont, IL (US)

(73) Assignee: Electro-Motive Diesel, Inc., LaGrange, IL (US)

( * ) Notice: Subject to any disclaimer, the term of this patent is extended or adjusted under 35 U.S.C. 154(b) by 0 days.

(21) Appl. No.: 13/691,103

(22) Filed: Nov. 30, 2012

(65) Prior Publication Data

US 2014/0156119 A1 Jun. 5, 2014

(51) Int. Cl.
*B61C 3/00* (2006.01)
*B61C 17/12* (2006.01)

(52) U.S. Cl.
CPC ..... *B61C 17/12* (2013.01)
USPC ..... 701/19; 701/32.7

(58) Field of Classification Search
CPC ..... B61C 3/00; B61C 17/12
USPC ..... 701/19, 20, 34.4, 31.6, 32.7; 105/61, 48
See application file for complete search history.

(56) References Cited

U.S. PATENT DOCUMENTS

| | | | |
|---|---|---|---|
| 3,696,758 | A | 10/1972 | Godinez, Jr. |
| 4,603,471 | A | 8/1986 | Strain |
| 5,720,455 | A | 2/1998 | Kull et al. |
| 5,813,635 | A | 9/1998 | Fernandez |

(Continued)

FOREIGN PATENT DOCUMENTS

| | | | | |
|---|---|---|---|---|
| CN | 1775606 | A | * | 5/2006 |
| CN | 101794142 | A | * | 8/2010 |

OTHER PUBLICATIONS

U.S. Office Action dated Dec. 2, 2013, for U.S. Appl. No. 13/690,797.

(Continued)

*Primary Examiner* — Mary Cheung
*Assistant Examiner* — Rodney Butler
(74) *Attorney, Agent, or Firm* — Finnegan, Henderson, Farabow, Garrett & Dunner LLP

(57) ABSTRACT

The present disclosure is directed to a distributed control system for a locomotive. The distributed system may include a network, a plurality of electronic modules and a plurality of control elements distributed within the locomotive. Each of the electronic modules is communicatively coupled to the network in a standardized scalable architecture. Each of the electronic modules may be programmatically reconfigurable to implement distributed control of the locomotive. A first electronic module and a second electronic module of the plurality of electronic modules may be communicatively connected to one of the plurality of control elements via separate communication paths. The first electronic module may be configured to control the control element, and the second electronic module may be configured to control the control element when the first electronic module enters into a failure condition.

18 Claims, 7 Drawing Sheets

(56) References Cited

U.S. PATENT DOCUMENTS

| | | | | |
|---|---|---|---|---|
| 5,845,272 | A | 12/1998 | Morjaria et al. | |
| 5,892,441 | A | 4/1999 | Woolley et al. | |
| 5,959,568 | A | 9/1999 | Woolley | |
| 6,098,006 | A | 8/2000 | Sherwood et al. | |
| 6,275,165 | B1 | 8/2001 | Bezos | |
| 6,314,345 | B1 * | 11/2001 | Coombes | 701/19 |
| 6,397,129 | B1 | 5/2002 | Lanoix et al. | |
| 6,401,015 | B1 | 6/2002 | Stewart et al. | |
| 6,759,951 | B2 | 7/2004 | Kellner et al. | |
| 6,789,004 | B2 | 9/2004 | Brousseau et al. | |
| 6,834,219 | B2 | 12/2004 | Proulx | |
| 6,863,246 | B2 | 3/2005 | Kane et al. | |
| 6,964,457 | B2 | 11/2005 | Kettle, Jr. | |
| 6,972,670 | B2 | 12/2005 | LaDuc et al. | |
| 7,021,589 | B2 | 4/2006 | Hess, Jr. et al. | |
| 7,131,614 | B2 | 11/2006 | Kisak et al. | |
| 7,133,756 | B2 | 11/2006 | Jammu et al. | |
| 7,529,610 | B1 | 5/2009 | Fenske et al. | |
| 7,603,471 | B2 | 10/2009 | Sodergren | |
| 7,664,459 | B2 | 2/2010 | Smith, Jr. et al. | |
| 7,761,198 | B2 | 7/2010 | Bhardwaj | |
| 7,783,397 | B2 | 8/2010 | Peltz et al. | |
| 7,949,441 | B2 | 5/2011 | Baig et al. | |
| 7,983,805 | B2 | 7/2011 | Bryant | |
| 8,070,108 | B2 | 12/2011 | Severson | |
| 8,073,582 | B2 | 12/2011 | Kellner et al. | |
| 8,115,493 | B2 | 2/2012 | Gallagher et al. | |
| 8,190,315 | B2 | 5/2012 | Kraeling et al. | |
| 8,264,330 | B2 * | 9/2012 | Yeldell et al. | 340/10.1 |
| 2001/0002449 | A1 | 5/2001 | Eisenmann et al. | |
| 2005/0010338 | A1 | 1/2005 | Kraeling et al. | |
| 2005/0075764 | A1 | 4/2005 | Horst et al. | |
| 2006/0136761 | A1 | 6/2006 | Frasier et al. | |
| 2007/0061056 | A1 | 3/2007 | Valsorda | |
| 2007/0073453 | A1 | 3/2007 | Dalnodar et al. | |
| 2007/0086482 | A1 * | 4/2007 | Pruzan et al. | 370/466 |
| 2007/0208841 | A1 | 9/2007 | Barone et al. | |
| 2008/0195265 | A1 | 8/2008 | Searle et al. | |
| 2008/0208401 | A1 | 8/2008 | Kumar et al. | |
| 2008/0306640 | A1 | 12/2008 | Rosenthal et al. | |
| 2008/0315843 | A1 | 12/2008 | Bhardwaj | |
| 2009/0090818 | A1 | 4/2009 | Kumar | |
| 2009/0173839 | A1 | 7/2009 | Groeneweg et al. | |
| 2009/0173840 | A1 | 7/2009 | Brown et al. | |
| 2009/0177356 | A1 | 7/2009 | Plawecki | |
| 2009/0204278 | A1 | 8/2009 | Kellner et al. | |
| 2009/0234521 | A1 * | 9/2009 | Kumar et al. | 701/19 |
| 2010/0004805 | A1 | 1/2010 | Denis et al. | |
| 2010/0217462 | A1 * | 8/2010 | Shaffer et al. | 701/19 |
| 2010/0235142 | A1 | 9/2010 | Jammu et al. | |
| 2010/0256843 | A1 | 10/2010 | Bergstein et al. | |
| 2010/0318246 | A1 | 12/2010 | Bieker et al. | |
| 2010/0322267 | A1 | 12/2010 | Homma et al. | |
| 2010/0330875 | A1 | 12/2010 | Severson | |
| 2011/0060486 | A1 | 3/2011 | Meltser et al. | |
| 2011/0099413 | A1 | 4/2011 | Cooper et al. | |
| 2011/0172856 | A1 | 7/2011 | Kull | |
| 2011/0282525 | A1 | 11/2011 | Kraeling et al. | |
| 2012/0016542 | A1 | 1/2012 | Severson | |
| 2012/0089537 | A1 | 4/2012 | Cooper et al. | |
| 2012/0095626 | A1 | 4/2012 | Smith | |
| 2012/0123617 | A1 | 5/2012 | Noffsinger et al. | |
| 2012/0136515 | A1 | 5/2012 | Noffsinger et al. | |
| 2012/0173054 | A1 | 7/2012 | Schwenkel et al. | |
| 2012/0290156 | A1 * | 11/2012 | Woo et al. | 701/19 |
| 2013/0079959 | A1 | 3/2013 | Swanson et al. | |
| 2013/0190952 | A1 | 7/2013 | Severson | |
| 2013/0328596 | A1 | 12/2013 | Zoels et al. | |

OTHER PUBLICATIONS

U.S. Office Action dated Apr. 22, 2014, for U.S. Appl. No. 13/691,337.

U.S. Office Action dated Feb. 13, 2014, for U.S. Appl. No. 13/691,025.

U.S. Office Action dated Feb. 18, 2014, for U.S. Appl. No. 13/691,254.

U.S. Office Action dated Mar. 20, 2014, for U.S. Appl. No. 13/691,242.

U.S. Office Action dated Jul. 18, 2014, for U.S. Appl. No. 13/691,337.

U.S. Office Action dated Jul. 25, 2014, for U.S. Appl. No. 13/690,797.

* cited by examiner

BACK-UP AND REDUNDANCY OF MODULES IN LOCOMOTIVE DISTRIBUTED CONTROL SYSTEMS

TECHNICAL FIELD

The present disclosure relates generally to operation of a locomotive and, more particularly, to systems and methods for distributed control of a locomotive.

BACKGROUND

In traditional locomotives and locomotives within a consist arrangement, the on-board control systems are known to use a centralized computer-based control system. Typically, such conventional control systems for a locomotive may include a central processing unit on the locomotive, a user interface for the locomotive operator, and interfaces or backplanes connected to the central processing unit on the locomotive for communications with sensor input and actuator output. As such, conventional control systems provide a consolidated interface for the locomotive operator. For example, U.S. Pat. No. 7,131,614 (the '614 patent) describes a conventional locomotive control system with such elements. The '614 patent describes locomotive control hardware including a central computer processor.

However, the complexity of new systems desired to be on-board a locomotive as part of a control system may introduce problems to systems such as that described in the '614 patent. In other words, some of the problems currently encountered with conventional control systems include the complexity of disparate components within the control system that need to effectively communicate with each other. Additionally, some conventional control systems may suffer from a lack of robust, mission critical, extensible and scalable components, which results in an undesirably higher cost, a less standardized and flexible architecture, and undesirably complex and complicated control systems.

The presently disclosed distributed control system is directed to overcoming one or more of the problems set forth above and/or other problems in the art.

SUMMARY OF THE INVENTION

In accordance with one aspect, the present disclosure is directed to a distributed control system for a locomotive. The distributed control system may include a network, a plurality of electronic modules and a plurality of control elements distributed within the locomotive. Each of the electronic modules is communicatively coupled to the network in a standardized scalable architecture. Each of the electronic modules may be programmed and configured to implement distributed control of the locomotive. A first electronic module and a second electronic module of the plurality of electronic modules may be communicatively connected to one of the plurality of control elements via separate communication paths. The first electronic module may be configured to control the control element, and the second electronic module may be configured to control the control element when the first electronic module enters into a failure condition.

According to another aspect, the present disclosure is directed to a method for controlling a locomotive. The method may include monitoring a first electronic module of a plurality of electronic modules spatially distributed within the locomotive. The plurality of electronic modules are communicatively coupled to a network in a standardized scalable architecture and are programmatically reconfigurable to implement distributed control of the locomotive. The first electronic module and a second electronic module of the plurality of electronic modules may be communicatively connected to one of a plurality of control elements via separate communication paths. The first electronic module may be configured to control the control element. The method may also include determining whether the first electronic module enters into a failure condition. The method may further include, when the processor determines that the first electronic module enters into the failure condition, instructing, by the processor, the second electronic module to control the control element.

In accordance with yet another aspect, the present disclosure is directed to a consist. The consist may include a plurality of locomotives. Each locomotive may include a network, a plurality of electronic modules and a plurality of control elements distributed within the locomotive. Each of the electronic modules is communicatively coupled to the network in a standardized scalable architecture. Each of the electronic modules may be programmatically reconfigurable to implement distributed control of the locomotive. A first electronic module and a second electronic module of the plurality of electronic modules may be communicatively connected to one of the plurality of control elements via separate communication paths. The first electronic module may be configured to control the control element, and the second electronic module may be configured to control the control element when the first electronic module enters into a failure condition.

DETAILED DESCRIPTION

Figure 1:
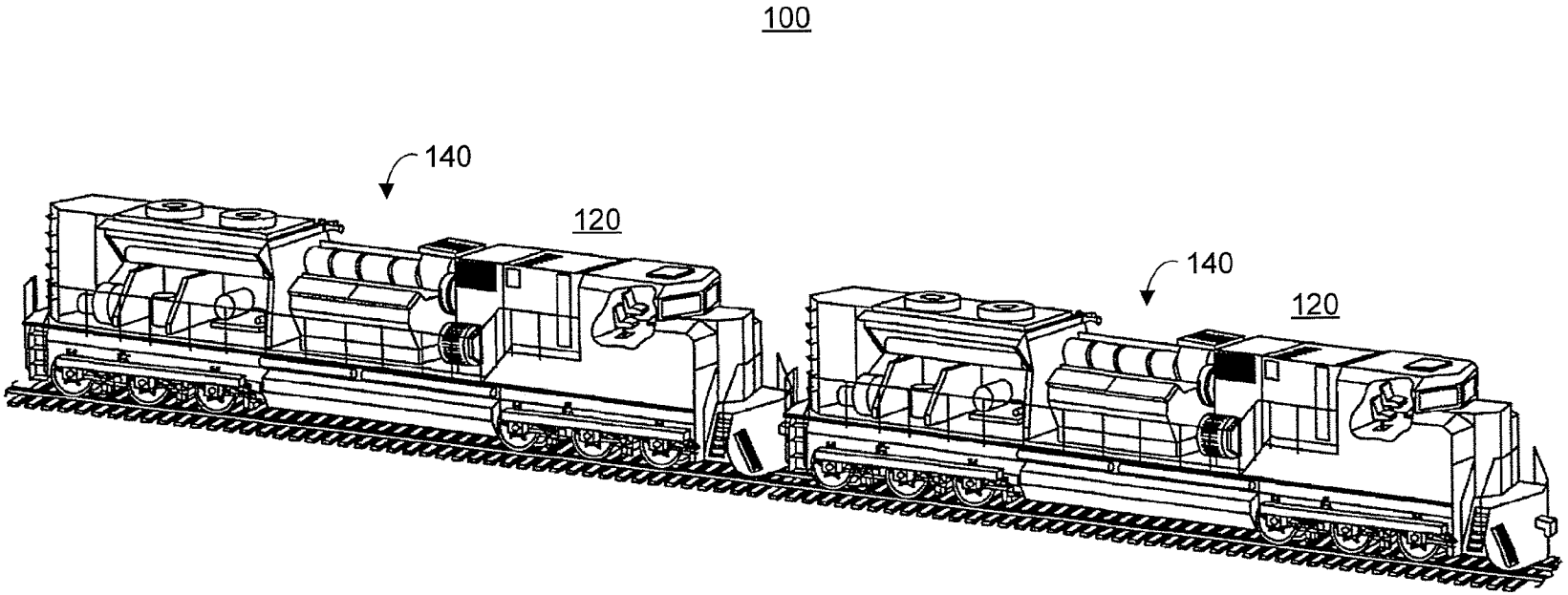
FIG. 1 illustrates a pictorial view of an exemplary consist of two locomotives.

FIG. 1 illustrates a consist 100 comprising a plurality of locomotives 120, the plurality including at least a first and a last locomotive 120. Each locomotive 120 may include a locomotive engine 140. In one embodiment, locomotive engine 140 may comprise a uniflow two-stroke diesel engine system. Those skilled in the art will also appreciate that each locomotive 120 may also, for example, include an operator cab (not shown), facilities used to house electronics, such as electronics lockers (not shown), protective housings for locomotive engine 140 (not shown), and a generator used in conjunction with locomotive engine 140 (not shown).

While not shown in FIG. 1, consist 100 may comprise more than two locomotives 120. Additionally, consist 100 may also comprise a variety of other railroad cars, such as freight cars or passenger cars, and may employ different arrangements of the cars and locomotives to suit the particular use of consist 100. In an embodiment, the locomotives within consist 100 communicate with each other through, for example, wired or wireless connections between the locomotives. Particular examples of such connections may include, but are not limited to, a wired Ethernet network connection, a wireless network connection, a wireless radio connection, a wired serial or parallel data communication connection, or other such general communication pathway that operatively links control and communication systems on-board respective locomotives of a consist.

Figure 2:
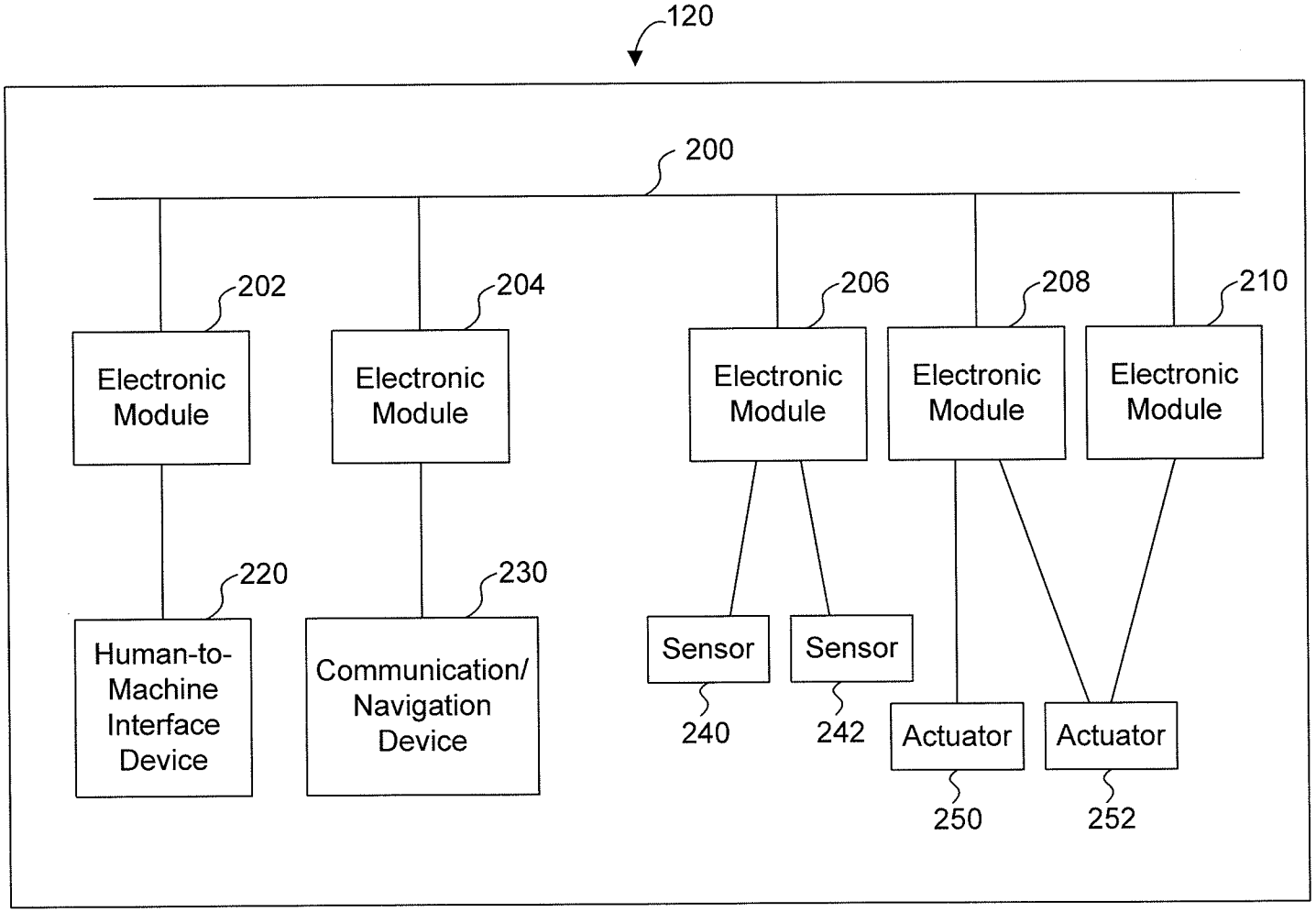
FIG. 2 provides a block diagram of an exemplary distributed control system that may be included in a locomotive of FIG. 1.

FIG. 2 illustrates elements of an exemplary distributed control system disposed within locomotive 120 for controlling locomotive 120. For example, the distributed control system controls the motion of locomotive 120 by controlling traction power of locomotive engine 140 and dynamic braking of locomotive 120. Referring now to FIG. 2, a network 200 is disposed within locomotive 120 as part of an exemplary distributed control system for locomotive 120. Network 200 may include one or more different data communication paths over which data having different communication formats may be transmitted. For example, network 200 may be used to transmit Ethernet TCP/IP based data, RS 232 data, RS422 data, controller area network (CAN) bus data, or a combination of two or more of these data. For example, different types of data may use differing parts of network 200, e.g., Ethernet data may use a physically separate data communication path of network 200 than CAN bus data. Alternatively, there may be priorities assigned to particular types of data. For example, in one embodiment, messages associated with CAN bus data may be assigned a higher priority than other types of messaging traffic on network 200.

As part of implementing control functions used to control the locomotive, the embodiment illustrated in FIG. 2 includes a plurality of electronic modules 202-210 communicatively coupled to network 200 in a standardized scalable architecture. In other words, electronic modules 202-210 are based on standardized hardware (e.g., similar components, similar boards, etc.), and software that can be flexibly configured and programmed in an architecture that allows for scalable additions depending on the needs of the control system. For example, in one embodiment, a single electronic module 202 may implement a particular control function. But if this control function is deemed or becomes a mission critical control function, an alternative embodiment may implement such a mission critical control function with several electronic modules. In one example, the use of several electronic modules to implement this control function may have been planned from the start. However, in another example, the system may dynamically allocate additional electronic modules to better handle the needs of the distributed control system from a mission critical perspective. Thus, if a particular electronic module hosts a mission critical application (e.g., throttle control of the locomotive engine, dynamic braking, etc.) that requires a lot of processing complexity such that the processing limit of the particular electronic module would be saturated, the mission critical application may be implemented with more than one electronic module. In another example, each electronic module 202-210 may host control applications (e.g., software applications) that consume a certain percentage of its processing capacity. When the consumption of processing capacity of a given electronic module, e.g., electronic module 202, exceeds a predetermined threshold, the overloaded electronic module 202 may offload one or more of its control applications to another electronic module, e.g., electronic module 204. By using standardized hardware (e.g., similar components, similar boards, etc.), implementing embodiments of a distributed control system of varying degrees of complexity may be accomplished using lower cost and standardized hardware and software. Doing so allows the system to be flexible and accommodate more robust control functions (e.g., engine control, human-to-machine interfacing, communications, sensing, actuating, etc.).

Electronic modules 202-210 may be spatially disposed within locomotive 120. As shown in FIG. 2, exemplary modules 202-210 may be spatially located in different parts of locomotive 120 to provide processing and interfacing support at disparate locations within locomotive 120, rather than rely upon a central processing device at a single location, such as in an operating cab of locomotive 120, for example. In an embodiment, the spatially disparate and distributed aspect of electronic modules 202-210 may allow for better protection from the harsh environment within locomotive 120 (e.g., shock, vibration, electrical noise, etc.). Additionally, such an embodiment with spatially disparate and distributed electronic modules 202-210 allows for ease of maintenance as electronic modules 202-210 may be placed in closer proximity to the devices being controlled (e.g., control elements).

Electronic modules 202-210 may be programmed and configured to communicatively connect to one or more control elements disposed within the locomotive. As shown in FIG. 2, exemplary control elements may include a human-to-machine interface device 220. Human-to-machine interface device is generally a device that provides feedback to and/or input from a human, such as the operator of the locomotive. Human-to-machine interface device 220 may include, but is not limited to, a monitor, a light emitting diode, an indicator, a switch, a button, a keypad, a keyboard, a touchpad, a joystick, a speaker, a microphone, and a biometric reader such as finger print scanner.

Another example of a control element is a communication/navigation device 230, which is generally a device that provides communication within or outside the locomotive or receives/transmits navigational information within or outside the locomotive. An example of communication/navigation device 230 may include, but is not limited to, an analog radio, a digital communication receiver/transmitter, a GPS unit, and a tracking transponder.

Sensors 240 and 242 and actuators 250 and 252 are additional examples of control elements operatively connected to one or more electronic modules 206, 208, and 210. Generally, a sensor may be any type of device that records or senses a condition or characteristic relative to locomotive 120, such as speed, temperature, atmospheric conditions, shock, vibration, frequency, engine conditions, etc. Various voltages (e.g., DC link voltage) and amperages (e.g., blower motor or traction motor amperage) may be used to represent the sensed conductions or characteristics. Similarly, an actuator may generally be any type of device that changes a condition or characteristic relative to the locomotive, such as a throttle, brake, heater, fuel flow regulator, generator, damper, pump, switch, relay, solenoid, etc. In one embodiment, an actuator may involve control of a mechanical or electrical device.

In an embodiment, a single electronic module may be connected to one or more control elements. For example, in FIG. 2, electronic module 206 is connected to both of sensors 240 and 242. Alternatively, in one embodiment, electronic module 206 may be connected to sensors 240 and 242, and actuators 250 and 252. Additionally, two or more electronic modules may be operatively connected to a given control element or to another electronic module to provide scalable monitoring and control resources for the control element in an architecture of standardized electronic modules. For example, in FIG. 2, electronic modules 208 and 210 are both connected to actuator 252. The configuration of how many electronic modules may be used with particular control elements will depend on the desired application within a locomotive. Those skilled in the art will appreciate that "standardized" generally means a basic commonality amongst the electronic modules, such as, for example, a similar chipset and board/daughter board configuration, but does not preclude electronic modules with different programming and populated with a subset of hardware on similar boards.

While FIG. 2 shows an exemplary embodiment of a distributed control system with example control elements that include sensors, actuators, a communication device, a navigation device, and a human-to-machine interface device, those skilled in the art will appreciate that embodiments may include other control elements useful in monitoring and controlling aspects of locomotive operation.

Figure 3:
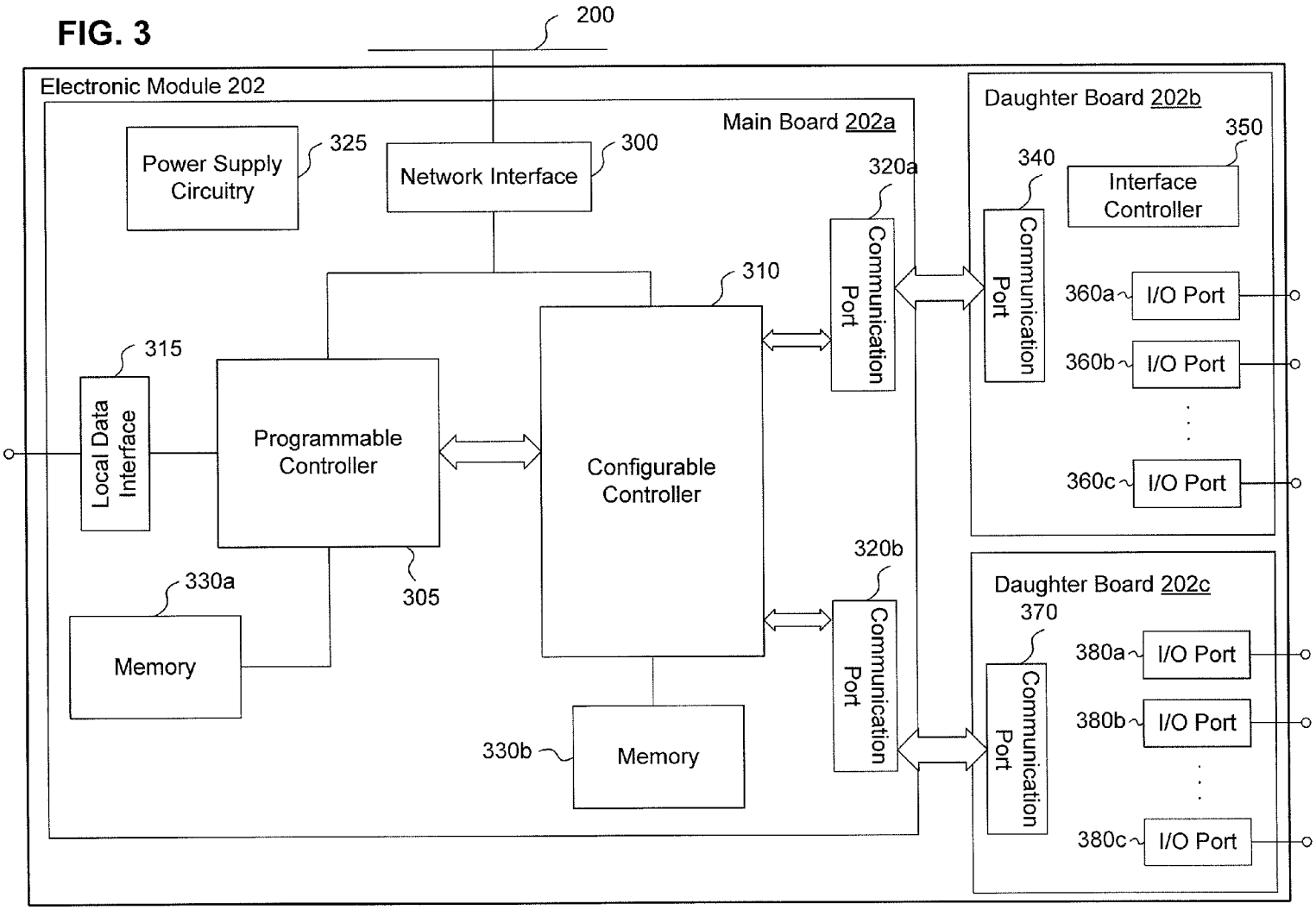
FIG. 3 provides a block diagram of exemplary electronic module within the distributed control system of FIG. 2.

FIG. 3 provides a block diagram of exemplary electronic module 202 within the exemplary distributed control system of FIG. 2. Referring now to FIG. 3, electronic module 202 may include a main board 202*a* and one or more daughter boards 202*b* and 202*c*. Main board 202*a* may be a standardized board common to other electronic modules 204-210 within the distributed control system. Electronic module 202 may further include a network interface 300, a programmable controller 305, a configurable controller 310, a local data interface 315, one or more communication ports 320*a* and 320*b*, a power supply circuitry 325, and memories 330*a* and 330*b* formed on main board 202*a*.

Power supply circuitry 325 generally provides appropriate power signals to different circuit elements within electronic module 202. Various other known circuits may be associated with electronic module 202, including gate driver circuitry, buffering circuitry, and other appropriate circuitry.

Network interface 300 may be configured to couple electronic module 202 to network 200. Network interface 300 may be coupled to both of programmable controller 305 and configurable controller 310. In one example, network interface 300 may be an Ethernet switch. However, other types of network or communication interfaces may suffice to operatively couple electronic module 202 to network 200. Additionally, in embodiments where network 200 includes different communication paths or subnetworks, network interface 300 may be implemented with one or more interface circuits to accommodate the different format or different physical paths of network 200. For example, the interface circuits of network interface 300 may accommodate transmission of Ethernet TCP/IP based data, RS 232 data, RS422 data, CAN bus data via network 200. Although not shown in FIG. 3, electronic module 202 may further include one or more network ports, such as Ethernet ports, into which network cables may be plugged.

Configurable controller 310 contains internal circuitry that is configurable to implement distributed control of locomotive 120. In other words, the internal circuitry of configurable controller 310 may be altered (e.g., internally reconnectable) in different configurations to implement one or more control functions associated with the distributed control of locomotive 120. In one embodiment, configurable controller 310 may be implemented by a field programmable gate array (FPGA) including programmable logic gates that may be reconfigured in how each of the programmable logic gates are interconnected when providing analog or digital control of one or more control elements. Configurable controller 310 may be configured to include a soft core processor such as a Nios processor in Altera® FPGAs. In some embodiments, a control application that is running on configurable controller 310 may require more sophistication and complexity. In this case, control application may be implemented by both configurable controller 310 and programmable controller 305, which has a higher processing capacity than configurable controller 310. Configurable controller 310 may be connected to memory 330*b*. Memory 330*b* may be configured to store configuration files used by configurable controller 310 to reconfigure the internal circuitry to perform certain functions related to the disclosed embodiments. In some embodiments, memory 330*b* may also store executable programs to be executed by the soft core processor in configurable controller 310. Memory 330*b* may include a volatile or non-volatile, magnetic, semiconductor, tape, optical, removable, nonremovable, or other type of storage device or computer-readable medium. In some embodiments, configurable controller 310 may be configured to include a memory to store, for example, the configuration files used by configurable controller 310.

Programmable controller 305 may be in communication with configurable controller 310 and network 200. Programmable controller 305 is programmatically adapted to provide computational support for a control function associated with electronic module 202. Exemplary communication between configurable controller 310 and programmable controller 305 may be accomplished with a peripheral component interconnect express (PCIe) bus or other high speed data bus that facilitates quick and efficient communication between the devices when implementing the control function. Alternatively, the communication between configurable controller 310 and programmable controller 305 may be accomplished through network 200. The control function, such as throttle control of the engine, may be at least one of a plurality of control functions associated with the distributed control of the locomotive. Computational support generally involves an offloaded task that may be accomplished with a processing unit, such as programmable controller 305, not in direct connection with the control element, such as a throttle actuator or speed sensor.

Programmable controller 305 may be removably connected to main board 202*a*. The software of programmable controller 305 may be programmed to provide computational support to electronic module 202, thus allowing for a more complex implementation of application than configurable controller 310. Programmable controller 305 may have a higher processing capacity than configurable controller 310 in terms of execution rate of instructions. Programmable controller 305 may be a microcontroller, a microprocessor, a Computer-On-Module (COM), or a System-On-Module (SOM). A SOM may have a processing capacity of 3 billion instructions per second. In one example, programmable controller 305 may be programmatically tasked with monitoring network 200 for messages. Programmable controller 305 may communicate with memory 330*a* formed on main board 202*a* of electronic module 202. Memory 330*a* may be used to store programs to be executed by programmable controller 305. Similar to memory 330*b*, memory 330*a* may include a volatile or non-volatile, magnetic, semiconductor, tape, optical, removable, nonremovable, or other type of storage device or computer-readable medium. Alternatively, programmable controller 305 may communicate with other local peripheral devices not formed on main board 202*a* (e.g., control elements 230, 240, 242, 250 and 252) via a local data interface 315. Local data interface 315 may be implemented, for example, using a USB or SATA format.

In some embodiments, configurable controller 310 of electronic module 202 may communicate with daughter boards

202*b* and 202*c* via the one or more communication ports 320*a* and 320*b*. Then, via input and output (I/O) ports formed on daughter boards 202*b* and 202*c*, configurable controller 310 of electronic module 202 may communicate with one or more control elements or the daughter boards of other electronic modules 204-210 within the distributed control system. Each one of daughter boards 202*b* and 202*c* may be electrically connected to configurable controller 310 in main board 202*a* via communication port 320*a* or 320*b* and a cable. The cable may contain several physical signaling lines. In one example, the cable may be formed as a flexible flat cable with fifty physical signaling lines, including power and ground lines.

Daughter board 202*b* may include a communication port 340, an interface controller 350, and I/O ports 360*a*, 360*b*, and 360*c*. Communication port 340 may be connected to communication port 320*a* in main board 202*a* via the cable. Interface controller 350 may be implemented by a complex programmable logic device (CPLD) or a FPGA, which may be configured to control data transmission (e.g., serial data transmission) via I/O ports 360*a*, 360*b*, and 360*c*. Alternatively, interface controller 350 may be implemented by a microcontroller that may be programmable to control data transmission via I/O ports 360*a*, 360*b*, and 360*c*. Interface controller 350 may also control one or more control elements connected to daughter board 202*b*. In some embodiments, one or more of I/O ports 360*a*, 360*b*, and 360*c* may be a RS232 data port, a RS422 data port, a LonTalk data port, or a GPS receiver. I/O ports 360*a*, 360*b*, and 360*c* enable communication between electronic module 202 and some control elements that require special data format, such as RS232 data, RS422 data, and/or LonTalk data. For example, a remote speed indicator which monitors and displays the speed of locomotive 120 may be communicated only via the RS 422 data port.

Daughter board 202*c* may include a communication port 370 and I/O ports 380*a*, 380*b*, and 380*c*. Communication port 370 may be connected to communication port 320*b* in main board 202*a* via another cable. In some embodiments, one or more of I/O ports 380*a*, 380*b*, and 380*c* may be a CAN port that enables communication between electronic module 202 and other control elements that require CAN bus data. For example, an Electro Motive Diesel Engine Controller (EMDEC) which controls the locomotive engine may be communicated only via the CAN port. Since CAN data transmission has a relatively stringent timing requirement, there is no need for an interface controller to control data transmission. In this case, configurable controller 310 in main board 202*a* may be configured to include a CAN controller for controlling data transmission between main board 202*a* and daughter board 202*c* having CAN ports.

Programmable controller 305 and configurable controller 310 may overlap in terms of their functions. That is, each one of programmable controller 305 and configurable controller 310 may independently interface with network 200 via network interface 300 to receive, process, initiate, and transmit messages. In addition, each one of programmable controller 305 and configurable controller 310 may have a processing capacity to host one or more control applications. However, programmable controller 305 may have a substantially large processing capacity, while configurable controller 310 may have relatively limited processing capacity.

In some embodiments, a control application of electronic module 202 may determine its need for processing capacity. The application may determine whether it can be implemented by only configurable controller 310, or whether it requires additional processing capacity from programmable controller 305. Applications that require relatively low processing capacity may be implemented by a certain electronic module that does not have a programmable controller, which will be discussed in greater detail below.

Figure 4:
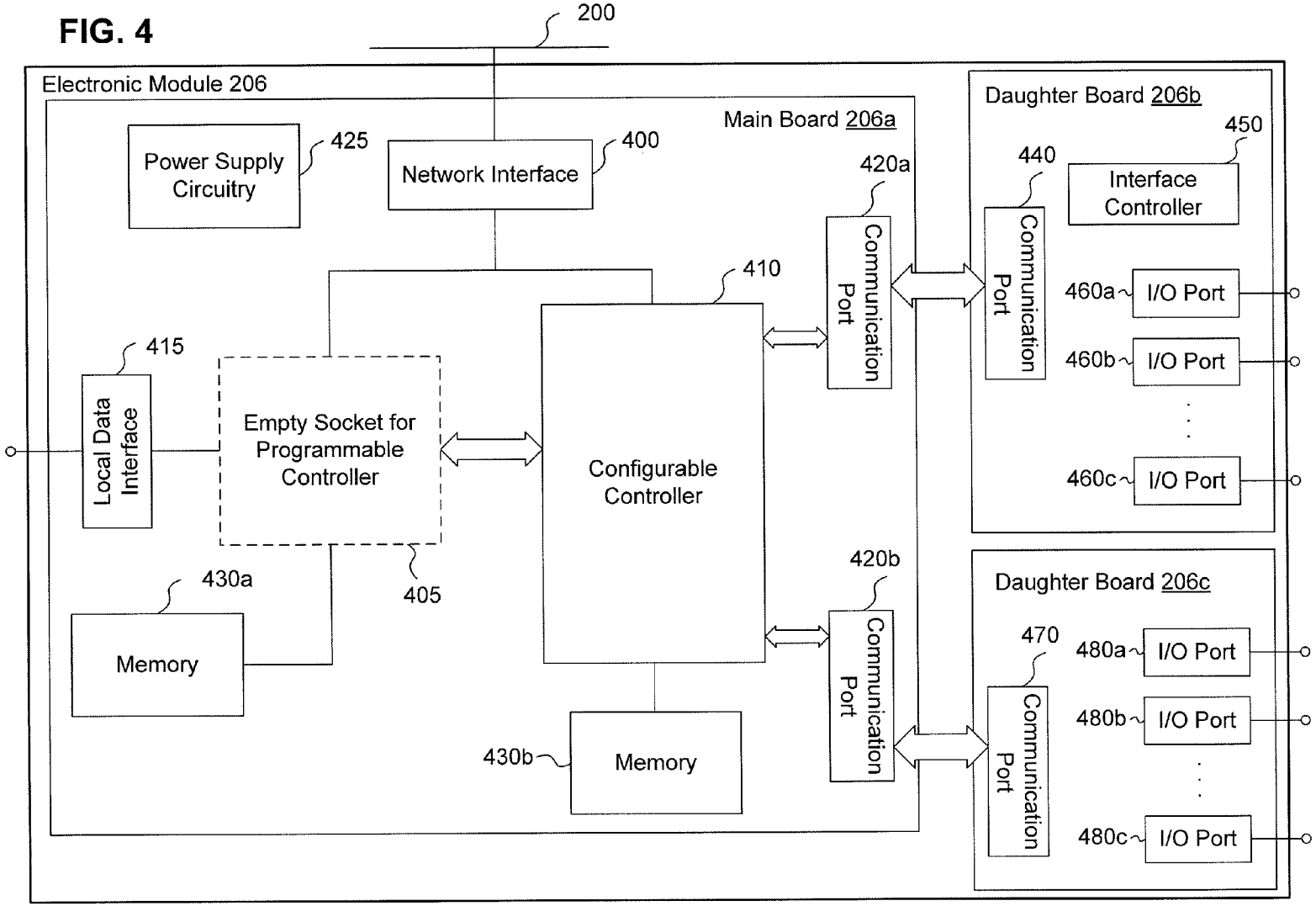
FIG. 4 provides a block diagram of another exemplary electronic module within the distributed control system of FIG. 2.

FIG. 4 provides a block diagram of an alternative exemplary electronic module within the distributed control system of FIG. 2. Referring now to FIG. 4, electronic module 206 may include a main board 206*a* and one or more daughter boards 206*b* and 206*c*. Main board 206*a* may include a network interface 400, a configurable controller 410, a local data interface 415, one or more communication ports 420*a* and 420*b*, a power supply circuitry 425, and memories 430*a* and 430*b*. However, this embodiment of an electronic module, such as electronic module 206, does not include a programmable controller. Instead, the standardized board used in electronic module 206 may be made without the chip or module that corresponds to programmable controller 305. That is, the standardized main board 206*a* used in electronic module 206 may be made with an empty socket 405 for a programmable controller. As such, electronic module 206 may be used to implement a control function that is not as resource or computationally intensive and does so at a lower cost. In this embodiment, monitoring responsibilities and other off-module interfacing is accomplished by configurable controller 410. Similar to daughter boards 202*b* and 202*c* shown in FIG. 3, daughter board 206*b* may include a communication port 440, an interface controller 450, and I/O ports 460*a*, 460*b*, and 460*c*, and daughter board 206*c* may include a communication port 470 and I/O ports 480*a*, 480*b*, and 480*c*.

In one embodiment, the distributed control system for a locomotive may use electronic modules that use both a programmable controller 305 and a configurable controller 310 (e.g., electronic module 202 illustrated in FIG. 3). In another embodiment, the distributed control system may use electronic modules that each use a configurable controller 410 but are not populated with a separate programmable controller (e.g., module 206 illustrated in FIG. 4). In yet another embodiment, the distributed control system may use a combination of electronic modules as illustrated in FIGS. 3 and 4 while still adhering to the standardized architecture of the modules in a system that is scalable for dynamic or different control tasks. Those skilled in the art will appreciate that the timing, robust requirements, and mission critical aspects of a particular control situation will influence which type of standardized electronic module to deploy within a distributed control system on a locomotive or consist.

Figure 5:
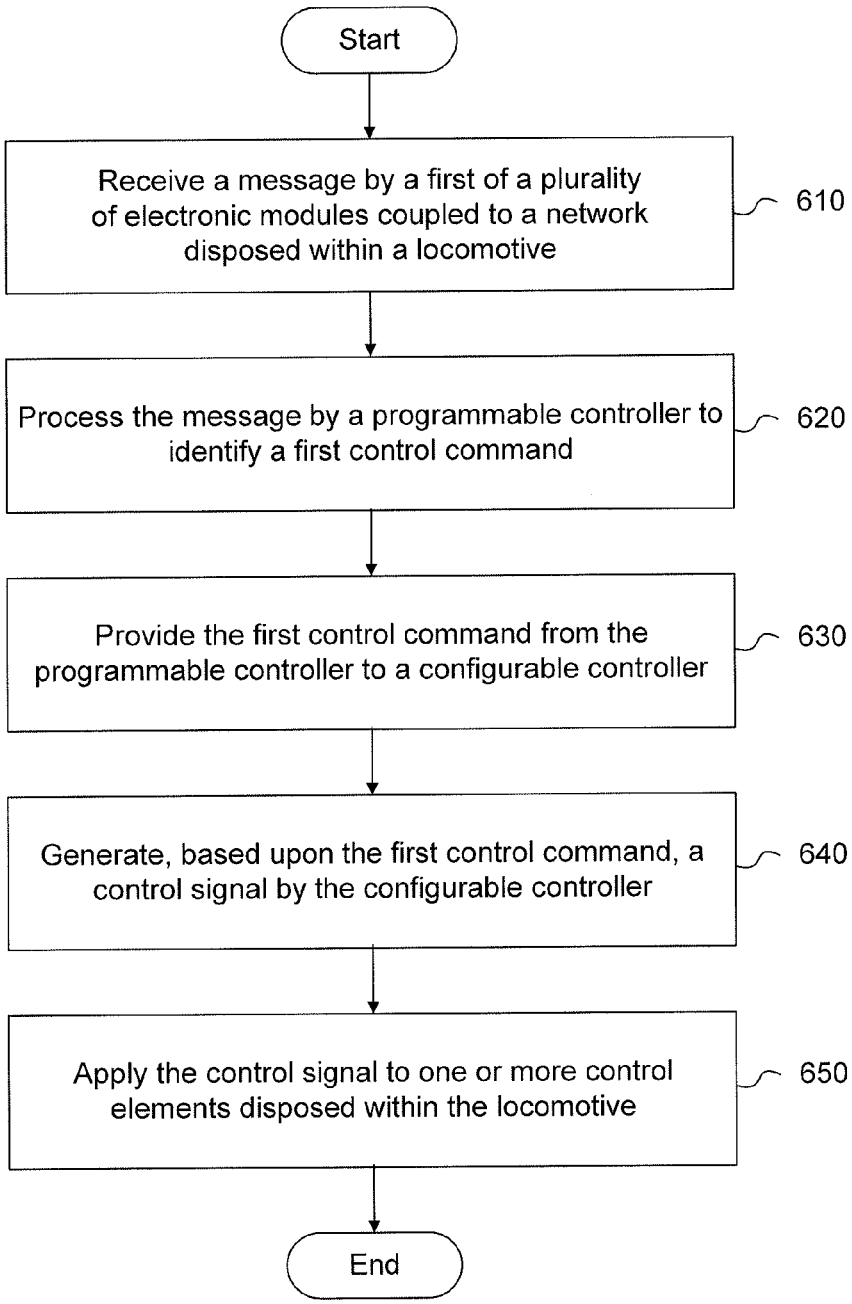
FIG. 5 provides a flowchart depicting an exemplary method for controlling a locomotive according to an embodiment of the present disclosure.

FIG. 5 provides a flowchart depicting an exemplary method for controlling a locomotive according to an embodiment of the present disclosure. The method may include receiving a message by a first of a plurality of electronic modules coupled to a network disposed within the locomotive (Step 610). Each of the electronic modules may be spatially distributed within the locomotive and operatively coupled to the network in a standardized scalable architecture, such as electronic modules 202-210, described above. The method may further include processing the message by a programmable controller in the first of the electronic modules, such as electronic module 204, to identify a first control command (Step 620). Generally, a control command is associated with one of a plurality of control functions. The message having information that can be processed to identify the control command may come from another electronic module, such as electronic module 202, that is operatively connected to human-to-machine interface device 220. The method may provide the first control command from the programmable controller (e.g., programmable controller 305) to a configurable controller (e.g., configurable controller 310) in the first of the electronic modules (Step 630). Based upon the identified first control command, the method may generate a control signal by the configurable controller (Step 640). The control signal is typically associated with at least one of a plurality of control functions as part of distributed control of the locomotive. In one embodiment, the control signal may take the form of an analog or digital signal. The control signal may include particular voltage, current or frequency characteristics useful in controlling the control element. The method may apply the generated control signal to one or more control elements (e.g., human-to-machine interface device 220, communication/navigation device 230, sensors 240 and 242, actuators 250 and 252, etc.) disposed within the locomotive (Step 650).

Figure 6:
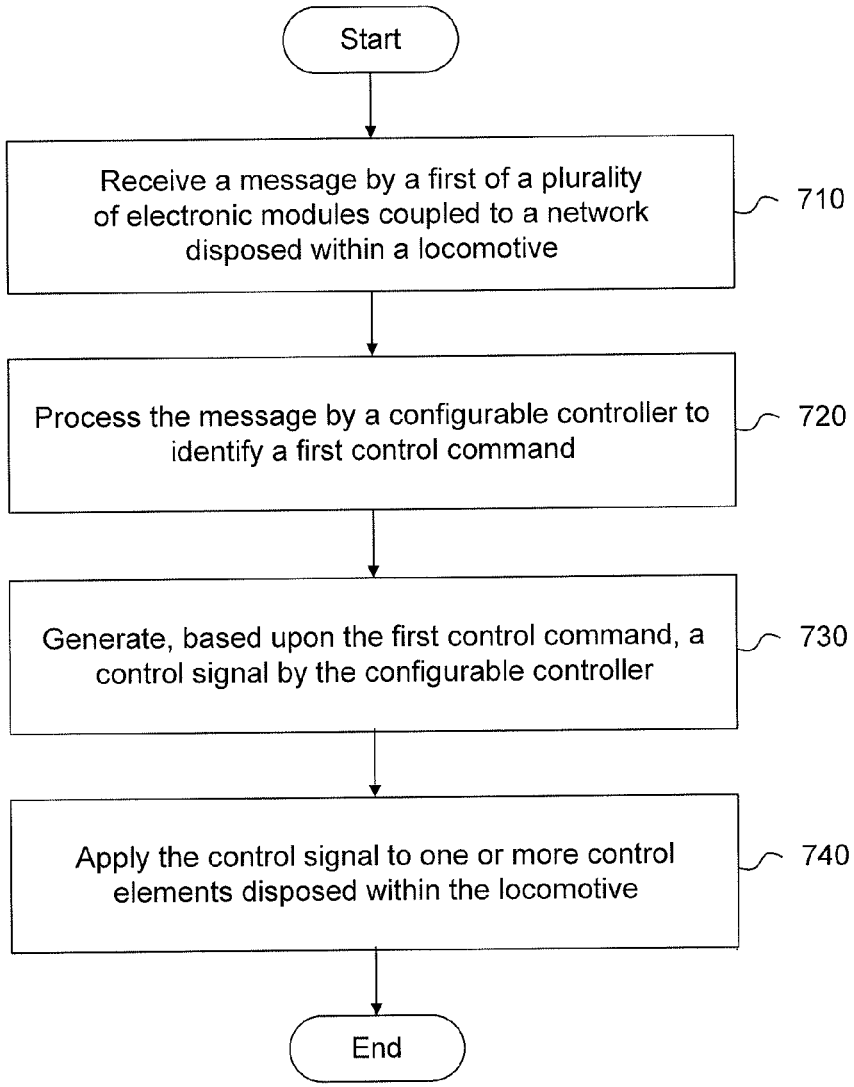
FIG. 6 provides a flowchart depicting an exemplary method for controlling a locomotive according to another embodiment of the present disclosure.

FIG. 6 provides a flowchart depicting an exemplary method for controlling a locomotive according to another embodiment of the present disclosure. The method may include receiving a message by a first of a plurality of electronic modules coupled to a network disposed within the locomotive (Step 710). The method may further include processing the message by a configurable controller in the first of the electronic modules to identify a first control command (Step 720). Based upon the identified first control command, the method may generate a control signal by the configurable controller (Step 730). The method may apply the generated control signal to one or more control elements disposed within the locomotive (Step 740).

Additionally, the method may receive a monitored locomotive signal from the one or more control elements. In one embodiment, a monitored locomotive signal is provided by a sensor, such as sensor 240, to configurable controller 310 via daughter board 202*b* or 202*c*, as part of monitoring the speed of the locomotive or as part of monitoring the temperature of locomotive engine 140. In response, the method may process the monitored locomotive signal within the first of the electronic modules and alter the generated control signal applied to the one or more control elements disposed within the locomotive. In the example mentioned above, the monitored locomotive signal may be processed by the configurable controller 310 or, if desired and equipped, by the programmable controller 305 within the electronic module.

In another embodiment, the method may reconfigure the configurable controller to cause the configurable controller to implement an alternative one of the control functions. In some exemplary embodiments, reconfiguring the configurable controller may alter interconnections of a plurality of programmable logic gates to implement the alternative one of the control functions. For example, an FPGA device may be used to implement the configurable controller and may be remotely reconfigured to implement an alternative control function. In this manner, those skilled in the art will appreciate the advantageous dynamic tasking of electronic modules and the ability to re-use electronic modules in differing configurations.

INDUSTRIAL APPLICABILITY

The disclosed distributed control system and methods provide a robust and improved solution for controlling a locomotive with a standardized and scalable architecture of distributed electronic modules. The disclosed systems and methods are able to handle robust, mission critical, and demanding control functions associated with control of the locomotive using distributed standardized electronic modules.

In some embodiments, one of the electronic modules may function as a back-up and redundant electronic module for another electronic module. For example, as shown in FIG. 2, electronic module 210 may be redundant to function as a back-up module for electronic module 208. In this example, both of electronic modules 208 and 210 may be simultaneously connected to actuator 252 via independent communication paths (e.g., via separate cables). Both of electronic modules 208 and 210 may be configured to separately perform the same algorithmic activity. In other words, the software inside electronic modules 208 and 210 may be programmed to perform the same computational function. However, only electronic module 208 is configured to implement a control function of controlling actuator 252 (e.g., sending instructions to actuator 252). When electronic module 208 enters into a failure condition, electronic module 210 may be configured to take over controlling actuator 252.

The failure condition of electronic module 208 may indicate a variety of failures. For example, electronic module 208 may enter into a failure condition when a consumption of processing capacity of electronic module 208 exceeds a threshold value. In other embodiments, electronic module 208 may enter into the failure condition when the communication between electronic module 208 and actuator 252 has failed. In still other embodiments, electronic module 208 may enter into the failure condition when electronic module 208 is unable to perform a designated control function.

The back-up and redundant electronic module 210 may be configured to monitor electronic module 208 and determine whether electronic module 208 enters into a failure condition. Alternatively, a third electronic module other than electronic modules 208 and 210, e.g., electronic module 206, may be configured to monitor electronic module 208 and determine whether electronic module 208 enters into a failure condition. In some embodiments, electronic module 206 may use sensor 240 to monitor a condition relative to locomotive 120 to determine whether electronic module 208 is able to perform a designated control function for controlling actuator 252. For example, electronic module 208 may be configured to control dynamic braking of locomotive 120, and electronic module 206 may use sensor 240 to sense the speed of locomotive 120 to determine whether electronic module 208 is functioning properly.

Figure 7:
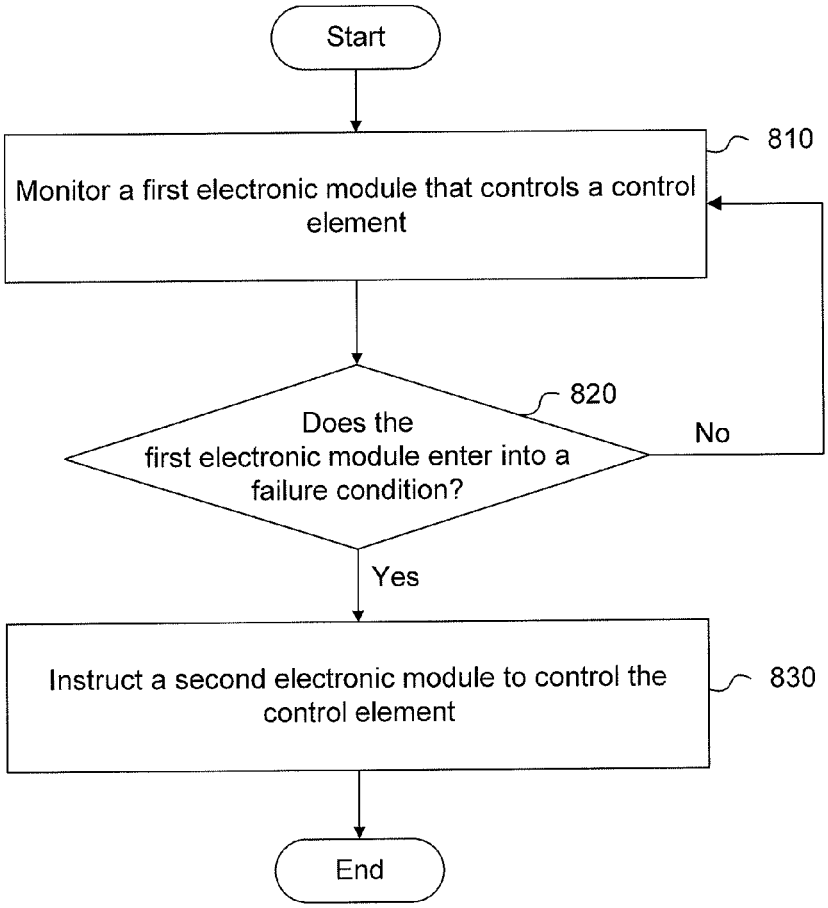
FIG. 7 provides a flowchart depicting an exemplary method for controlling a locomotive according to still another embodiment of the present disclosure.

FIG. 7 provides a flowchart depicting an exemplary method for controlling a locomotive according to another embodiment of the present disclosure. The method may include monitoring a first electronic module that controls a control element (Step 810). For example, electronic module 206 that controls actuator 252 as illustrated in FIG. 2 may be monitored. The method may include determining whether the first electronic module enters into a failure condition (Step 820). The method may further include, when the first electronic module enters into the failure condition (Step 820, Yes), instructing a second electronic module to control the control element (Step 830). When the first electronic module does not enter into the failure condition (Step 820, No), the process may return to step 810 where the first electronic module is monitored.

The presently disclosed distributed control system may have several advantages. Specifically, the presently disclosed distributed control system avoids undesirably high costs by providing spatially distributed electronic control modules using standardized components. The standardized components, such as an electronic peripheral control interface and, in some instances, a programmable controller, allow for a flexible, extensible, and scalable architecture while helping to avoid high maintenance costs and system downtime.

Additionally, the disclosed systems are able to use components, such as a configurable controller, which contain internal circuitry that is reconfigurable. This is especially beneficial when there is the need for quick and flexible replacement of components in the system, dynamic tasking of electronic modules within the system to handle differing control needs within the locomotive, or the ability to re-use electronic modules in differing configurations.

It will be apparent to those skilled in the art that various modifications and variations can be made to the disclosed distributed control system for a locomotive and associated methods for operating the same. Other embodiments will be apparent to those skilled in the art from consideration of the specification and practice of disclosed distributed control system for a locomotive. It is intended that the specification and examples be considered as exemplary only, with a true scope being indicated by the following claims and their equivalents.

What is claimed is:

1. A consist, comprising:

a plurality of locomotives, each locomotive comprising:

a network disposed within the locomotive;

a plurality of electronic modules spatially distributed within the locomotive, each of the electronic modules communicatively coupled to the network in a standardized scalable architecture and being programmatically reconfigurable to implement distributed control of the locomotive; and a plurality of control elements distributed within the locomotive, wherein a first electronic module and a second electronic module of the plurality of electronic modules are communicatively connected to one of the plurality of control elements via separate communication paths, the first electronic module is configured to control the control element, the second electronic module is configured to control the control element when the first electronic module enters into a failure condition, and wherein the first electronic module enters into the failure condition when a consumption of processing capacity of the first electronic module exceeds a threshold value.

2. A method for controlling a locomotive, the method comprising:

monitoring, by a processor in the locomotive, a first electronic module of a plurality of electronic modules spatially distributed within the locomotive, the plurality of electronic modules being communicatively coupled to a network in a standardized scalable architecture and being programmatically reconfigurable to implement distributed control of the locomotive, the first electronic module and a second electronic module of the plurality of electronic modules being communicatively connected to one of a plurality of control elements via separate communication paths, and the first electronic module being configured to control the control element;

determining, by the processor, whether the first electronic module enters into a failure condition, wherein determining whether the first electronic module enters into a failure condition includes determining whether the consumption of processing capacity of the first electronic module exceeds a threshold value; and when the processor determines that the first electronic module enters into the failure condition, instructing, by the processor, the second electronic module to control the control element.

3. The method of claim 2, wherein the processor is included in the second electronic module.

4. The method of claim 2, wherein the processor is included in a third electronic module of the plurality of electronic modules.

5. The method of claim 2, wherein determining whether the first electronic module enters into a failure condition includes determining whether the first electronic module is able to perform a designated control function.

6. The method of claim 2, wherein determining whether the first electronic module enters into a failure condition includes determining whether a communication between the first electronic module and the control element is failed.

7. The method of claim 2, wherein the first and second electronic modules are configured to perform the same algorithmic activity.

8. The method of claim 2, wherein each of the plurality of electronic modules includes a configurable controller, an internal circuitry of the configurable controller being reconnectable in different configurations to implement at least one of a plurality of control functions associated with distributed control of the locomotive.

9. The method of claim 8, wherein at least one of the electronic modules further includes a programmable controller in communication with each of the configurable controller and the network.

10. A distributed control system for a locomotive, comprising:

a network disposed within the locomotive;

a plurality of electronic modules spatially distributed within the locomotive, each of the electronic modules communicatively coupled to the network in a standardized scalable architecture and being programmatically reconfigurable to implement distributed control of the locomotive; and a plurality of control elements distributed within the locomotive, wherein a first electronic module and a second electronic module of the plurality of electronic modules are communicatively connected to one of the plurality of control elements via separate communication paths, the first electronic module is configured to control the control element, the second electronic module is configured to control the control element when the first electronic module enters into a failure condition, and wherein the first electronic module enters into the failure condition when a consumption of processing capacity of the first electronic module exceeds a threshold value.

11. The distributed control system of claim 10, wherein the first and second electronic modules are configured to perform the same algorithmic activity.

12. The distributed control system of claim 10, wherein each of the plurality of electronic modules includes a configurable controller, an internal circuitry of the configurable controller being reconnectable in different configurations to implement at least one of a plurality of control functions associated with distributed control of the locomotive.

13. The distributed control system of claim 12, wherein the configurable controller is a field programmable gate array.

14. The distributed control system of claim 12, wherein at least one of the electronic modules further includes a programmable controller in communication with each of the configurable controller and the network.

15. The distributed control system of claim 1, wherein the second electronic module is configured to monitor the first electronic module to determine whether the first electronic module enters into the failure condition.

16. The distributed control system of claim 1, wherein a third electronic module of the plurality of electronic modules is configured to monitor the first electronic module to determine whether the first electronic module enters into the failure condition.

17. The distributed control system of claim 1, wherein the first electronic module enters into the failure condition when a communication between the first electronic module and the control element is failed.

18. The distributed control system of claim 1, wherein the first electronic module enters into the failure condition when the first electronic module is unable to perform a designated control function.

* * * * *